US006793022B2

(12) United States Patent
Vick et al.

(10) Patent No.: US 6,793,022 B2
(45) Date of Patent: Sep. 21, 2004

(54) SPRING WIRE COMPOSITE CORROSION RESISTANT ANCHORING DEVICE

(75) Inventors: Michael Lee Vick, Carrollton, TX (US); Marion Dewey Kilgore, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/115,686

(22) Filed: Apr. 4, 2002

(65) Prior Publication Data

US 2003/0188876 A1 Oct. 9, 2003

(51) Int. Cl.[7] ..... E21B 33/129

(52) U.S. Cl. ..... 166/382; 166/118; 166/217; 166/387

(58) Field of Search ..... 166/136, 137, 166/138, 140, 209, 210, 211, 215, 216, 217, 206, 118, 382, 387, 902; 175/423; 29/557, 558, 428, 888.044, 888.049

(56) References Cited

U.S. PATENT DOCUMENTS

| | | | | | |
|---|---|---|---|---|---|
| 2,084,611 | A | | 6/1937 | Crickmer | |
| 2,670,797 | A | | 3/1954 | Armentrout | |
| 2,687,775 | A | | 8/1954 | Baker | |
| 3,412,803 | A | | 11/1968 | Stachowiak | |
| 3,531,716 | A | | 9/1970 | Tarui et al. | |
| 4,151,875 | A | | 5/1979 | Sullaway | |
| 4,302,018 | A | * | 11/1981 | Harvey et al. | 277/322 |
| 4,834,184 | A | | 5/1989 | Streich et al. | |
| 5,224,540 | A | | 7/1993 | Streich et al. | |
| 5,258,706 | A | | 11/1993 | Brunner et al. | |
| 5,404,110 | A | | 4/1995 | Golladay | |
| 5,663,967 | A | | 9/1997 | Lindberg et al. | |
| 5,984,007 | A | * | 11/1999 | Yuan et al. | 166/118 |
| 6,167,963 | B1 | | 1/2001 | McMahan | |
| 6,513,600 | B2 | * | 2/2003 | Ross | 166/387 |

FOREIGN PATENT DOCUMENTS

| | | |
|---|---|---|
| EP | 0 523 594 | 7/1992 |

* cited by examiner

*Primary Examiner*—David Bagnell
*Assistant Examiner*—Matthew J Smith
(74) *Attorney, Agent, or Firm*—John F. Booth; Peter V. Schroeder

(57) ABSTRACT

A slip for use in the anchoring device on a well tool has a wedge shaped body and teeth on the exterior of the body. The teeth are formed from a ring segment of spring steel material mounted on and extending from the exterior of the body. The ring segment may be mounted in a circumferential groove on the body.

28 Claims, 6 Drawing Sheets

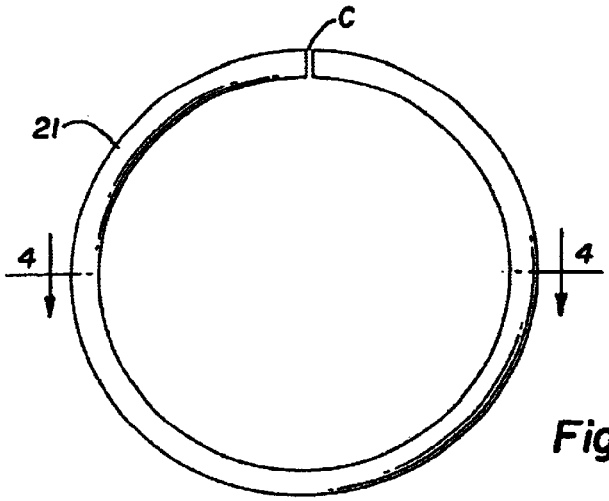
Fig. 3
Fig. 4
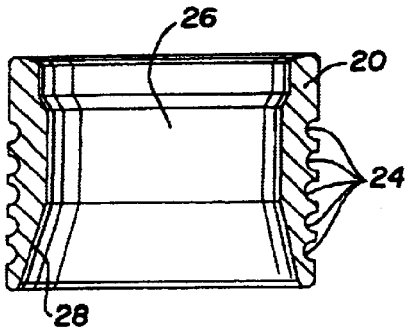
Fig. 5
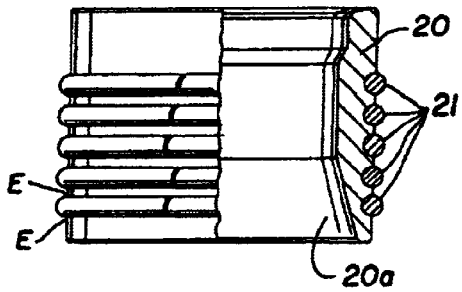
Fig. 6

SPRING WIRE COMPOSITE CORROSION RESISTANT ANCHORING DEVICE

TECHNICAL FIELD

The present inventions relate to improvements in anchoring devices for wells and methods of manufacture and use. More particularly the present inventions relate to a corrosion resistant device for use in wells to engage the wall of a well tubular to lock the device in place wherein the anchoring device consists of a tubular wall engaging spring-tempered wire teeth attached to a corrosion resistant base.

BACKGROUND OF THE INVENTIONS

Previous designs for corrosion resistant anchoring devices have consisted of tungsten carbide button-type insert teeth either brazed or press-fitted in a corrosion resistant base. Carbide materials are typically used to provide sufficient hardness and strength to penetrate and engage the wells casing or tubing wall to mechanically lock and hold stationary packers or other down-hole tools in place in oil or gas wells. One problem with using carbide material has been the tendency for the material to chip, crack or crumble during deployment.

SUMMARY OF THE INVENTIONS

The present inventions contemplate an improved anchoring device for use in wells and methods of manufacture. The anchoring device comprises spring-tempered wire ring segments replacing the conventional carbide button inserts in slip segments that cooperate with a slip wedge. The spring wire composite corrosion resistant anchoring device consists of corrosion resistant spring-tempered wire ring segment attached to a corrosion resistant base to function as a well anchor. The spring-tempered wire is used to provide sufficient hardness and strength. Unlike carbide buttons, the spring-tempered wire does not have the tendency to chip, crack or crumble during deployment.

The anchoring device of the present invention is manufactured using one or more spring-tempered snap rings set in grooves formed in the corrosion resistant base with portions extending from the exterior of the base to act as teeth. The wire can be attached to the base using an electron beam welding process. A tooth profile is machined or ground into the ring. The ring is cut into segments. The base is also segmented; in one embodiment the base is axially slotted leaving portions joining adjacent segments and in another embodiment no joining portions are left.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which:

FIG. 3 is a plan view of one embodiment of the spring-tempered ring insert;

FIG. 4 is a sectional view taken on line 4—4 of FIG. 3 looking in the direction of the arrows;

FIG. 5 is a sectional view illustrating a cross section of an embodiment of the base in a manufacturing step according to the method of the present inventions;

FIG. 6 is a sectional view illustrating a cross section of an embodiment of the base and ring in a manufacturing step according to the method of the present inventions;

DETAILED DESCRIPTION

Figure 1:
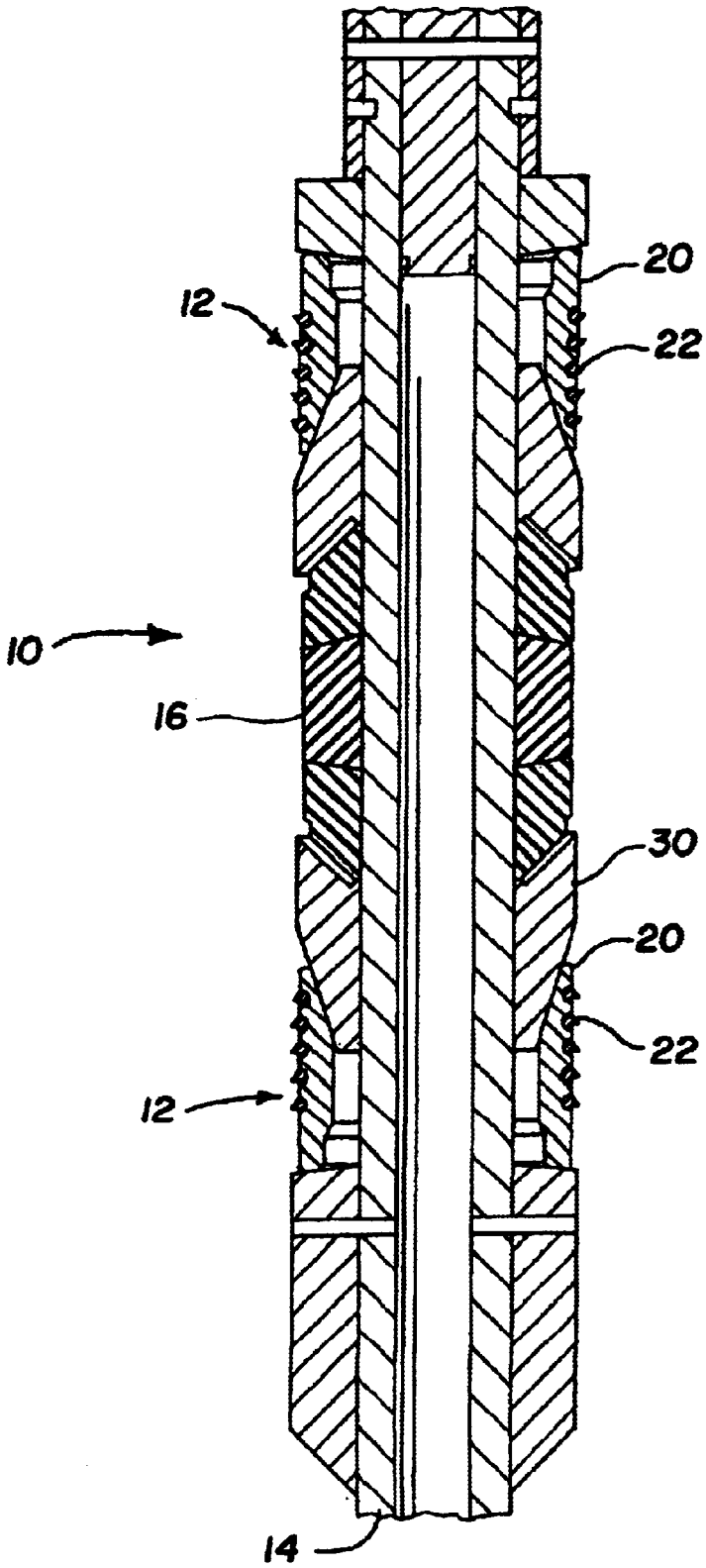
FIG. 1 is a side elevation view in section illustrating an embodiment of the well anchor apparatus of the present invention shown assembled in a bridge plug well tool shown in the run condition prior to installation at a subterranean location in a well.

The present inventions are described by reference to drawings showing one or more examples of how to manufacture and use the present inventions. Reference characters used in the drawing indicate like or corresponding parts throughout the figures.

Figure 2:
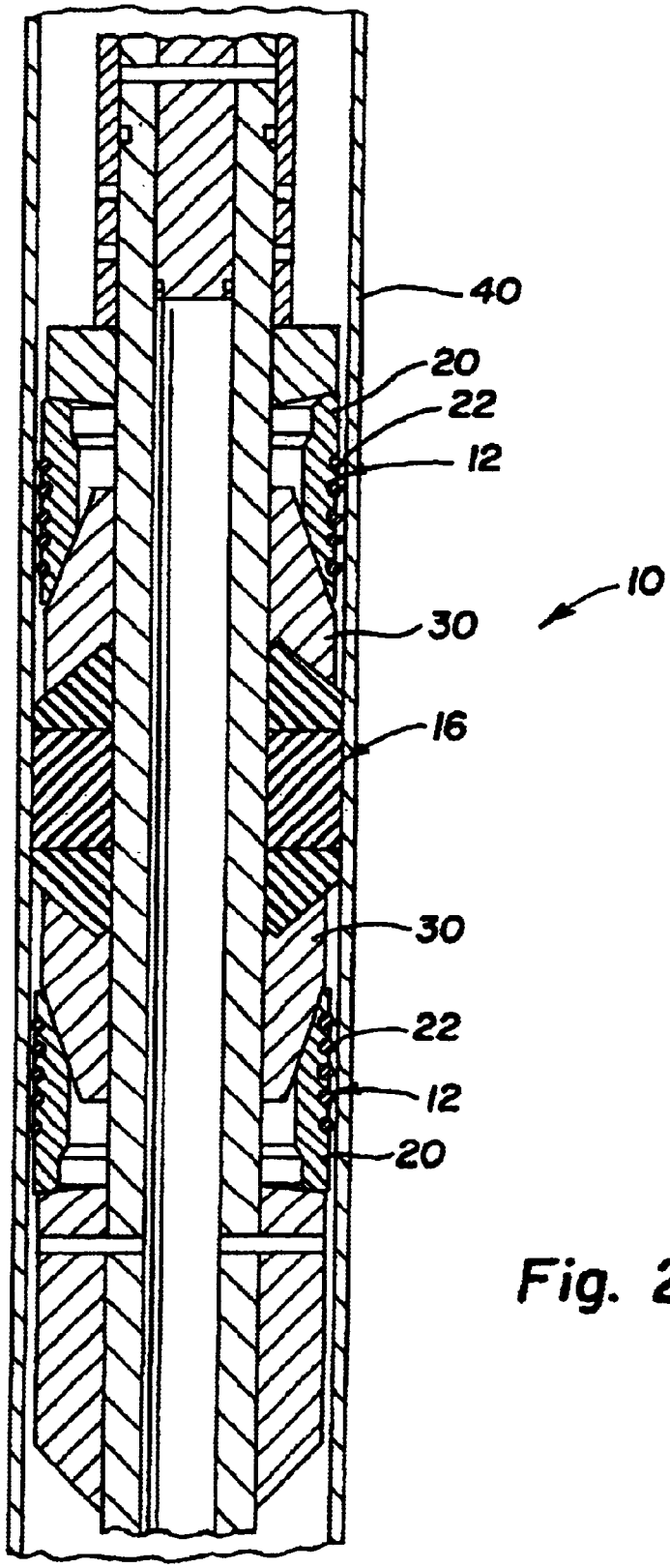
FIG. 2 is a view of the tool of FIG. 1 set in a well casing.

The anchoring device of the present invention has utility with a variety of downhole well tools. In FIGS. 1 and 2, the inventions are illustrated assembled in a well tool in the form of a bridge plug 10. In FIG. 1 the bridge plug is in the run or unset condition and in FIG. 2 it is in the set condition. Bridge plug 10 has two (2) anchoring assemblies 12 mounted around a mandrel 14 on opposite sides of an elastomeric seal-packer assembly 16.

Each of the anchoring assemblies 12 comprises an anchor body 20 divided into slip segments with ring segments 22 forming wicker type teeth thereon and a cone assembly 30 for forcing the segments outward during setting. As used herein slips refers to wedge shaped members with teeth or other gripping elements thereon. Wickers are a form of teeth or slip gripping elements used to securely maintain a tool within the casing or tubing. Wickers are circumferentially extending ridges or tooth profiles on the exterior of the slip segment for engaging the well. There can be a plurality of wickers on the outer surface of a slip, and as the segments of the slip are moved radially outwardly toward the wall of the well by a longitudinal force applied to the slip, the wickers penetrate or bite into the wall of the casing. Segments or slip segments is used to describe slips that are separately movable during setting even though they may be connected or attached together before setting. Setting is a procedure in which a tool engages the well to lock or secure the tool in place. The term cone refers to a wedge or frusto conical shaped surface on a device that cooperates with the slips.

As will be described in detail each of the ring segments 22 are preferably made from spring tempered steel rings. When the bridge plug 19 is lowered into a well casing 40 (See FIG. 2) and set (by a running tool not shown), the packer element 16 is axially compressed and radially expanded to seal against the interior wall of the casing 40. When set the wicker teeth ring segments 22 on the two anchoring assemblies 12 engage the interior wall 40 to lock bridge 19 plug in position in the well bore casing 40. Non-corrosive materials are used to make the anchoring body and ring segments. Acceptable materials include: a high chrome base material such as alloy 718 for the body and Elgiloy or MP35N material for the ring segments. Preferably, the materials need to be noble so they can be welded together and meet NACE requirements for corrosive service. It is appreciated that these spring steel wickers are not as subject to breakage as tungsten carbide buttons. These materials resist breakage during installation and setting of the tool.

One embodiment for manufacturing the anchoring device described by reference to FIGS. 3–10. In this embodiment a plurality of tempered spring steel rings 21 are assembled on a premachined body 20. Rings 21 (illustrated in FIGS. 3 and 4) are in the form of a snap-ring and have a circular cross section. However, as will be pointed out, various cross sections could be used. Ring 21 is cut at C so that the ring can be expanded to fit in grooves on the body 20.

FIG. 5 illustrates the preferred embodiment of the body 20. Body 20 has a generally continuous cylinder shape with a plurality of semi-circular cross section grooves 24 formed in the exterior surface thereof. The cross section of these grooves matches the cross section of the rings 21 to allow the rings 21 to be tightly received in the grooves 24 as shown in FIG. 6. A portion of the cross section of each ring 21 protrudes from the surface of the body and it is this portion that will form the tooth profile.

Body 20 has a central passageway 26 there through of a size to fit on the exterior of the mandrel 14. Passageway 26 is tapered or flared outwardly at 20*a*. The angle of the taper is designed to ride along and engage the outer surface of a cone 30.

In FIG. 6, a ring 21 has been installed in each of the grooves 24. In accordance with the present invention each, the ring 21 is attached to the body 20 along the edges E of the grooves 24. Attachment can be accomplished by numerous means depending on the materials use and other factors but include at least attachment by welding, brazing, bonding, press fitting, swaging, adhesives or other suitable means. Attachment need not be continuous along the edges E, but should be enough to retain the ring segments on the body segments after cutting.

Figure 7:
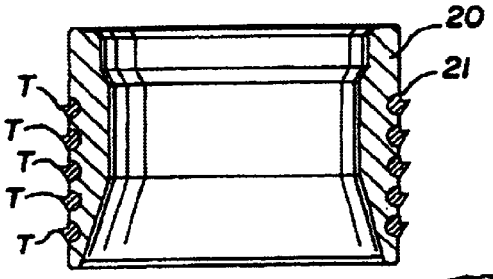
FIG. 7 is a sectional view illustrating a cross section of an embodiment of the base and ring in a manufacturing step according to the method of the present inventions.
Figure 8:
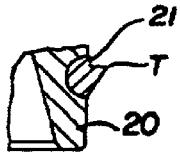
FIG. 8 is a detail sectional view similar illustrating the profile of the ring in the base in a manufacturing step according to the method of the present inventions.

Once the rings 21 are attached to the body 20, ridge-like teeth "T" can be formed in the exposed surface of the ring as shown in FIG. 7. A detail of one tooth configuration is shown in FIG. 8. Tooth profile "T" can be formed in the rings 22 after installation in the body by machining, grinding, and the like or the tooth profile can be formed before installation in the body.

Figure 9A:
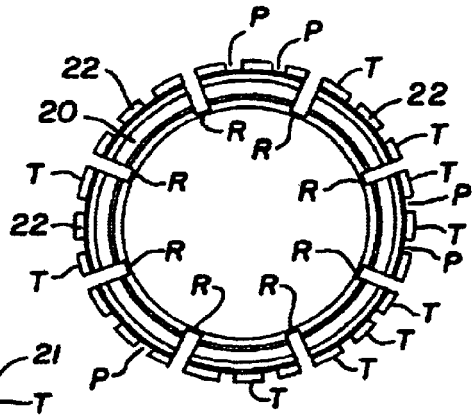
FIG. 9A is a view similar to FIG. 9 of an alternate embodiment.
Figure 9:
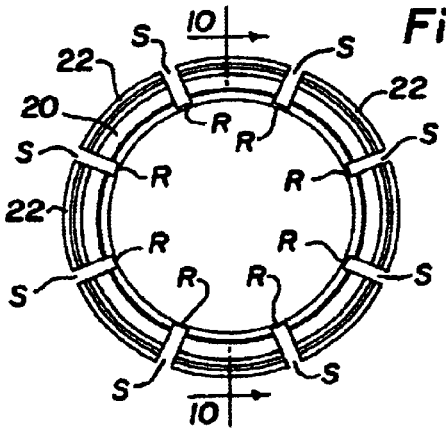
FIG. 9 is an end view of one embodiment of a completed anchoring device of the present inventions.
Figure 10:
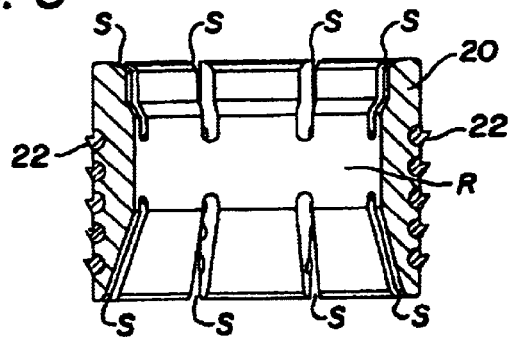
FIG. 10 is a sectional view of the embodiment of completed anchoring device taken on line 10—10 of FIG. 9 looking in the direction of the arrows.

Either before or after profiles "T" had been formed, the body 20 and rings 21 are cut in an axial direction to form the slots "S" illustrated in FIGS. 9 and 10. Slots "S" define separate ring segments 22. In the illustrated embodiment slots "S" cut or divide the body and rings into eight segments. However as few as two or more than eight segments could be formed. Adjacent body segments are joined together by an integrally formed ring-like structure "R". Leaving a material bridge between adjacent segments forms the ring-like structure "R". The ring "R" maintains the body segments in an annular shape during running of the tool. The bridges of material are designed to fracture upon setting of the tool allowing the body segments to separate and move independently.

In the embodiments illustrated in FIGS. 9–10, an anchoring device body for use with and expansion by a cone or wedge is illustrated. The body is divided into slip segments (initially joined together by an integrally formed ring) which segments upon setting move along the cone to separate from each other, spread out, and move radially outward. Each body segment has at least one wall engaging wicker-type tooth profile extending circumferentially across the exterior surface thereof. This tooth profile is in the form of an external edge of ring material and extends substantially across each segment for engaging the casing wall to lock the tool in position.

According to the present inventions circumferentially extending portions of each of its ring segments 22*b* could be removed to form separate non-wickered teeth. In FIG. 9A an alternative configuration is shown with portions "P" removed from the ring segments 22 to leave circumferentially spaced teeth "T".

Figure 11:
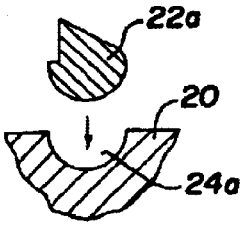
FIG. 11 is an enlarged section view illustrating an alternative ring profile and mounting.

In FIG. 11 an alternative embodiment for installing the wicker tooth forming rings 22*a* is illustrated. In this embodiment the rings 22*a* each have a preformed tooth profile and a shank portion fitting in a semi-circular cross section slot 24*a*. Once the ring 22*a* is installed, it can be attached to the body and the body slotted as previously described.

Figure 12:
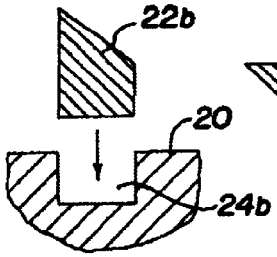
FIG. 12 is an enlarged section view illustrating a second alternative ring profile and mounting.

In FIG. 12 an alternate embodiment, the ring 22*b* is illustrated being installed in slot 24*b*. Slot 24*b* has a straight-sided cross section and the shank portion of the ring 22*b* fits snuggly therein. In this embodiment a point or tooth profile is preformed on the ring 22*a*. It should be appreciated that the slot cross section could also be a combination of straight and curved sides.

Figure 13:
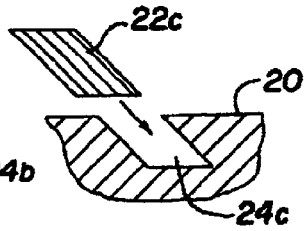
FIG. 13 is an enlarged section view illustrating another alternative ring profile and mounting.

In FIG. 13 a second alternate embodiment is illustrated wherein the slot 24*c* cross section is straight sided but two of the sides are at acute angles to the body center line. Snap ring 22*c* has the general shape of a spring washer and fits into the slot 24*c*.

In these alternative tooth embodiments the rings are attached to the body as is described in the previous embodiment and the tooth profile can be pre-formed or formed after the ring is in place.

Figure 14:
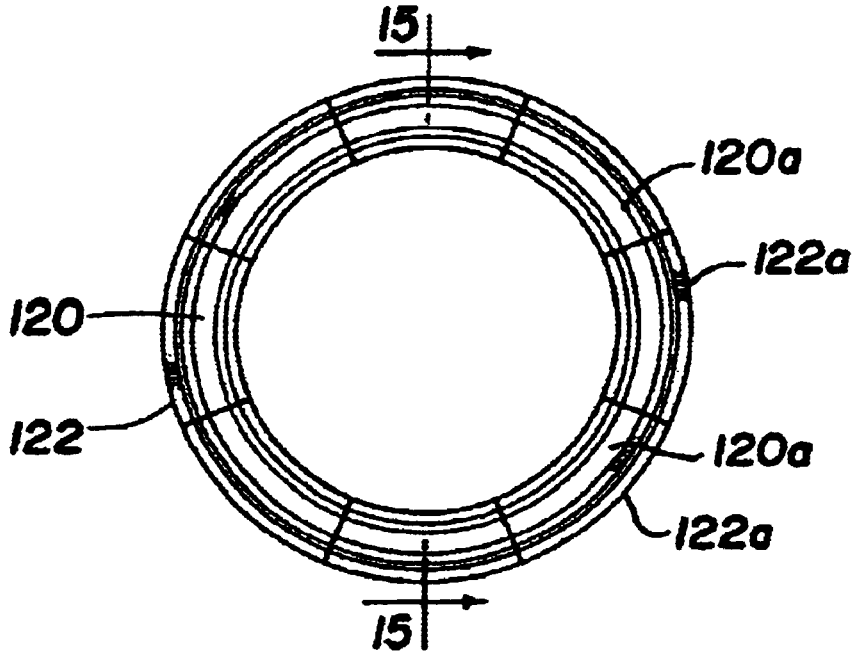
FIG. 14 is an end view of another embodiment of a completed anchoring device of the present inventions.
Figure 15:
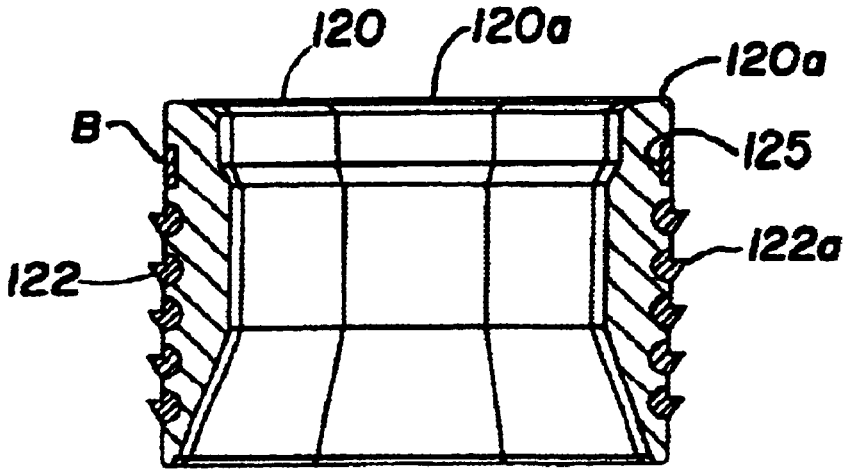
FIG. 15 is a sectional view of the embodiment of completed anchoring device taken on line 15—15 of FIG. 14 looking in the direction of the arrows.

In FIGS. 14 and 15, an alternative embodiment of an anchor body is shown. In this embodiment, the rings 122 are installed on the body 120 and the tooth profiles formed thereon, however during the slotting operation, the ring 122 and body 120 are cut into separate unconnected segments 120*a* and 122*a*, respectfully. The body and rings are initially formed to accommodate the setting diameter and when cut, sufficient material is removed, so that, the segments reassemble at the run diameter of FIG. 1. To hold these segments in place a groove 125 is formed on the exterior of each of the body segments 120*a* and a continuous frangible band B is placed therein to hold the segments in place during running. Upon setting band B breaks, allowing the individual segments to move independently.

Figure 16:
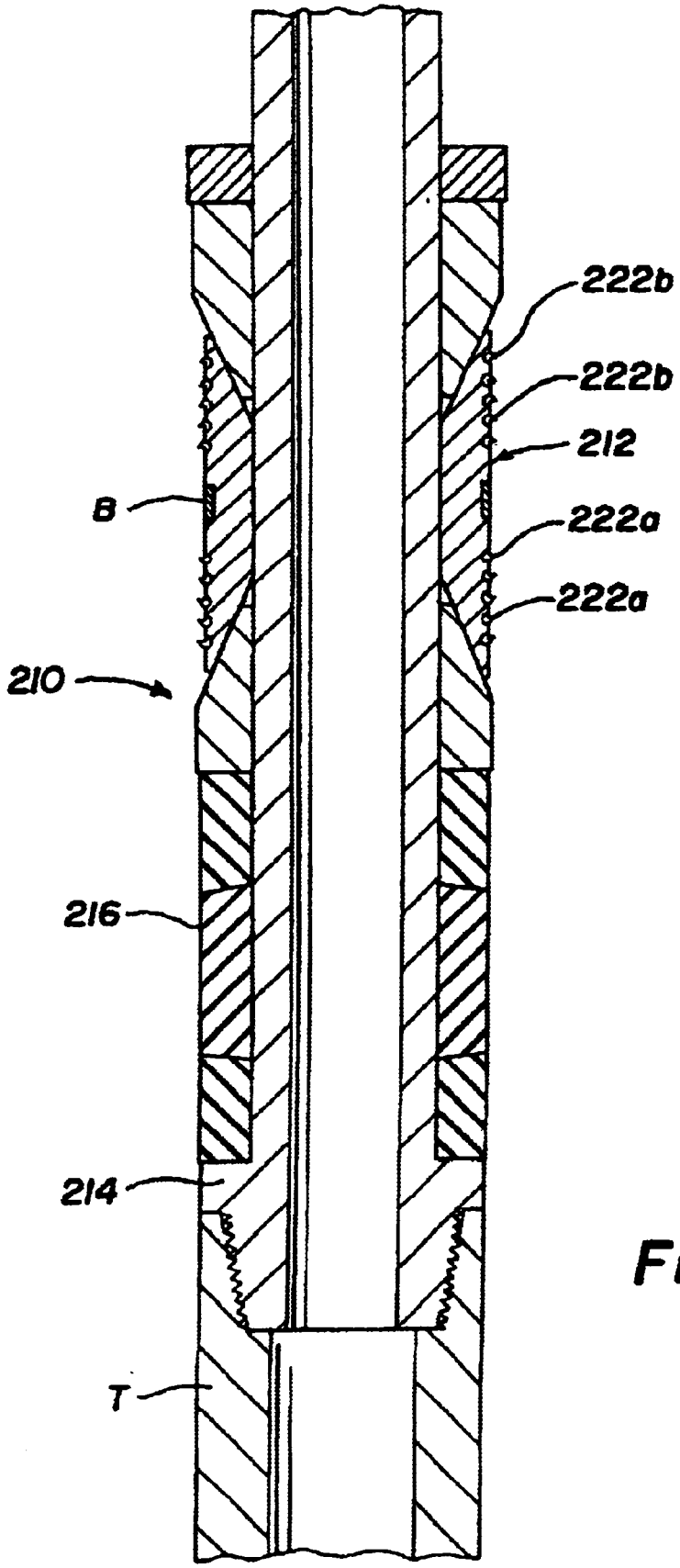
FIG. 16 is a side elevation view in section view illustrating another embodiment of the well anchor apparatus of the present invention shown assembled in a packer well tool in the run condition prior to installation in a subterranean location in a well.

In FIG. 16, the present inventions are illustrated used in a packer assembly 210. In this figure, assembly 210 is shown in the run position connecting in a length of well tubing T. Packer 210 has a mandrel 214 with a packer element 216 mounted thereon. A single set of bi-directional anchors 212 are positioned on the mandrel above the packer element 16. In this embodiment, a plurality of sets of ring segments 222*a* and 222*b*, with tooth profiles facing in opposite directions are utilized to anchor the packer in the well bore. The anchoring device can be divided into unconnected segments retained in position by frangible band B. The packer could also be constructed with ring-like portions integrally formed to retain the segments in the run position. The anchors 212 can be formed according to any of the embodiments shown in FIGS. 1–15.

Many types of means for retaining the slips in the run position could be use. An example of a frangible band used to retain slips on a tool in the run position is illustrated in the United States patents to Streich, et al. U.S. Pat. No. 4,834,184 and to Sullaway U.S. Pat. No. 4,151,875 which patents are incorporated herein by reference. Shear pins used to retain the segments together are shown in the Crickmer U.S. Pat. No. 2,084,611, which patent is incorporated herein by reference. Additionally, one or more of the segment retaining means could be used, for example, pins or a band used with a bridge formed between some but not all of the adjacent segments such as is shown in the Baker U.S. Pat. No. 2,687,775, which is incorporated herein by reference.

The embodiments shown and described above are only exemplary. Many details of anchoring devices are found in the art such as: slip wedges, slip cones, retaining means, packer elements, anti extrusion rings, and tool actuator designs. Therefore, many such details are neither shown nor described.

It is not claimed that all of the detail parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed:

1. A slip for use in the anchoring device on a well tool comprising:

a segmented wedge shaped body, the wedge shaped body radially expandable by separation of the segments and teeth for anchoring the tool in a well on the exterior of the body, each tooth being formed from a ring segment mounted on and extending from the exterior of the body.

2. The slip of claim 1 additionally comprising a circumferential groove in the exterior of the body and the ring segment is mounted in the groove.

3. The slip of claim 1 wherein the ring segment is formed from spring steel material.

4. The slip of claim 1 wherein the ring segment is mounted on the body by welding.

5. The slip of claim 1 wherein the body segments are completely separated from one another.

6. The slip of claim 1 additionally comprising a retaining means for retaining the body segments in an annular shape.

7. The slip of claim 6 wherein the retaining means is a frangible band.

8. The slip of claim 6 wherein the retaining means comprises a ring integrally formed with the body segments.

9. A slip assembly for use in the anchoring device on a well tool comprising:

a radially expandable segmented annular body and at least one circumferentially extending tooth on the exterior of each body segment, each tooth being formed from at least one ring segment mounted on and extending from the exterior of the body segment.

10. The slip assembly of claim 9 additionally comprising a circumferential groove in the exterior a body segment and the ring segment is mounted in the groove.

11. The slip assembly of claim 9 wherein the ring segment is formed from spring steel material.

12. The slip assembly of claim 9 wherein the ring segment is mounted on the body by welding.

13. The slip assembly of claim 9 additionally comprising means for retaining the body segments in an annular shape.

14. The slip assembly of claim 13 wherein the retaining means comprises a breakable ring.

15. The slip assembly of claim 13 wherein the retaining means comprises a ring integrally formed with the body segments.

16. A tool for use in a tubular member at a subterranean location of a well comprising:

a mandrel;

an anchoring device on the mandrel to engage the wall of the tubular member and anchor the tool in place in the well, the anchoring device comprising a segmented slip assembly mounted on the mandrel to move from a refracted run position to a radially expanded set position engaging the tubular member, the slip assembly radially expandable by separation of the slip assembly segments; and rings segment mounted on the slip assembly segments with at least a portion of the ring segments extending from the exterior surface of the slip assembly segments as teeth for engaging the tubular member.

17. The slip assembly of claim 16 additionally comprising:

a circumferential groove in the exterior a body slip assembly segment; and the ring segment is mounted in the groove.

18. The slip assembly of claim 16 wherein the ring segment is formed from spring steel material.

19. The slip assembly of claim 16 wherein the ring segment is mounted on the body by welding.

20. The slip assembly of claim 16 additionally comprising means for retaining the body segments in an annular shape.

21. The slip assembly of claim 16 wherein the retaining means comprises a breakable ring.

22. The slip assembly of claim 16 wherein the retaining means comprises a ring integrally formed with the body segments.

23. A method of forming an anchoring device for use in contacting the wall of a well tubing at a subterranean location comprising the steps of:

forming an annular body of corrosion resistant material, forming at least one circumferential extending groove in the external surface of the body, installing at least a portion of a metal ring in the groove, and forming at least two axially extending cuts in the body and ring to divide the body and ring into segments.

24. The method of claim 23 wherein the cutting step completely separates adjacent segments ring and adjacent body segments.

25. The method of claim 23 wherein the cutting step leaves an integral ring retaining the segments connected together.

26. The method of claim 23 additionally comprising the step of forming a tooth profile on the ring.

27. The method of claim 23 wherein the metal ring is a snap ring.

28. The method of claim 23 wherein the metal ring is a spring tempered ring.

* * * * *